United States Patent [19]

Tancredi

[11] 3,934,280

[45] Jan. 27, 1976

[54] DRAIN-FLUSHING DEVICE

[76] Inventor: Pier Luigi Tancredi, c/o IASA International, Inc. 972 Lexington Ave., New York, N.Y. 10021

[22] Filed: May 21, 1975

[21] Appl. No.: 579,316

Related U.S. Application Data

[63] Continuation-in-part of Ser. No. 545,436, Jan. 30, 1975.

[52] U.S. Cl. ..... 4/255

[51] Int. Cl.[2] ..... E03D 11/00

[58] Field of Search ..... 222/3; 137/240, 246.22; 4/255, 256, 257; 15/104.3, 104.06, 104.05

[56] References Cited

UNITED STATES PATENTS 2,697,842 12/1954 Meyer ..... 4/255

*Primary Examiner*—Allen N. Knowles
*Assistant Examiner*—Hadd Lane

[57] ABSTRACT

In a preferred embodiment, the cylinder is of substantially large dimensions, such as typically having an inner diameter of about four inches, for the drain compression flushing device, still retaining the conical spout element defining a restricted liquid outlet orifice, and having spaced upwardly from the spout-end of the compression cylinder a circumscribing seating flange angled radially outwardly in a direction toward the handle end such that in an enlarged opening the spout element tends to seat itself firmly to seal while making possible for the orifice to be located far downwardly within space defined by the enlarged drain outlet such as for industrial use and/or for a commode or the like, and such as a large handle.

2 Claims, 1 Drawing Figure

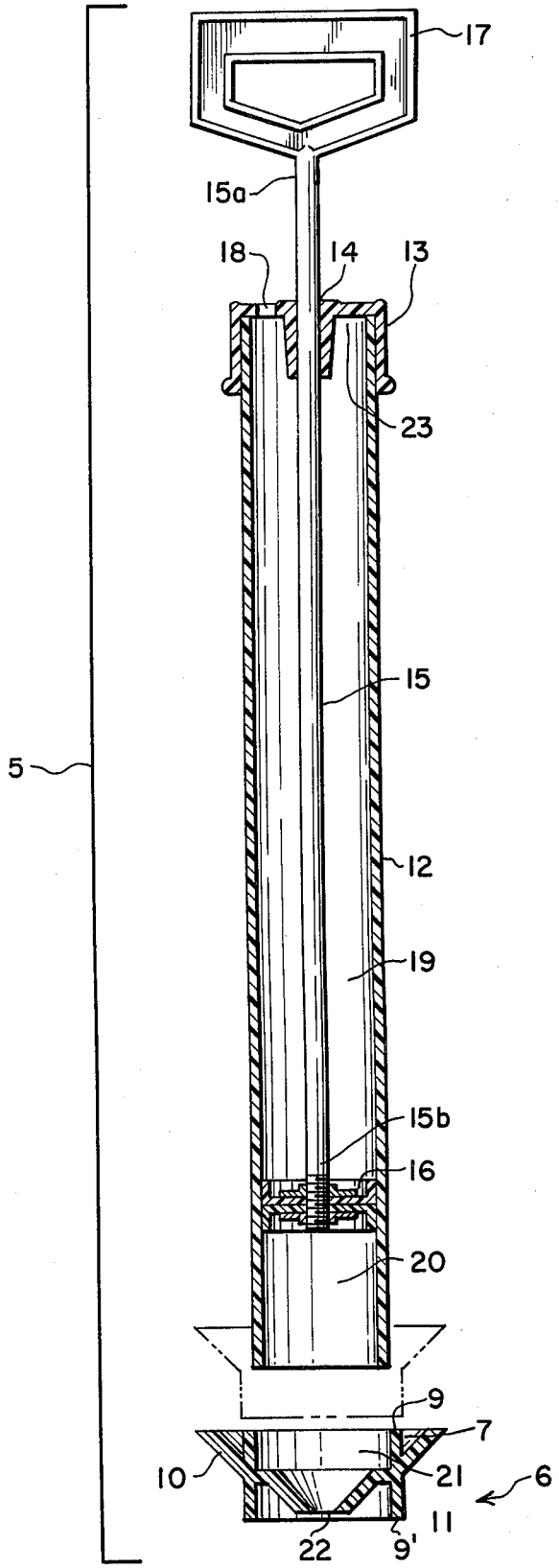
Fig.

DRAIN-FLUSHING DEVICE

This invention is a Continuation-in-part of the parent application of the same title and basic invention, having U.S. Ser. No. 545,436, filed Jan. 30, 1975.

The present invention is directed to an improved structure better adapted for drains of large size and unique problems.

BACKGROUND OF THE INVENTION

Prior to the present invention, it often happens that the sink gets clogged-up or plugged, and in home or industrial use, valuable time and costly repair services result often, moreover it being desirable to avoid the use of corrosive chemical that eventually lead to leaks together with more major problems and costs associated therewith. Although conventional plungers and plumbers' snakes are often of value, in more than minor problems such remedies are not satisfactory, moreover a typical person or worker not being sufficiently skilled with a plumbers' snake to maneuver the same properly. Heretofore, there has not existed any suitable alternative to the ordinary worker in need of an effective and easily operative alternative device of low cost not requiring any particular special skills.

SUMMARY OF THE INVENTION

For drains or outlets of larger dimensions, it is an object of the present invention to overcome problems and difficulties of the type discussed above, together with the obtaining of novel advantages.

Another object is to obtain a novel device for breaking-up clogged material, in the opening of drains connected to sinks or basins, or commodes or the like.

Another object is to obtain an anti-clog device being of simple mechanical structure susceptible of low cost of manufacture with regard to both parts and labor, and accordingly susceptible of low prices of sale to the consuming public, thereby making such device available economically to the buying public.

Another object is to obtain a device having multiple utility, such as for use in the alternative as a siphon for effectively withdrawing articles accidentally dropped down the sink drain.

Other objects become apparent from the preceding and following disclosure.

One or more objects of the invention are obtained by the invention as defined herein.

The invention of this improvement may be defined broadly as an enlarge structure suitable for heavy duty typical of industrial use and/or for use with a toilet drain, for example, with therefore thickened walls of the cylinder and the spout element, and an enlarged and sturdy compression disk, shaft for the piston shaft thereof, and handle for firm grasping and powerfully pumping the same, in the compressing stroke particularly in the forcing the water downwardly through a drain pipe, the major improvement being a circumscribing radially-outwardly and upwardly flared flange spaced upwardly from the spout end such that the conical end and small orifice is located deeply below the sealed seating effected against a lower face of the flange, and such that because of the upwardly flared shape the base of the cylinder tends to center itself as a result of the downward pressure applied to the cylinder while pressing downwardly on the handle to compressably force previously siphoned-up water downwardly at great pressure and speed to break-up the clogging matter. Although these above-described features are believed novel and therefor are intended to be utilized with any appropriate compressor unit, in a preferred embodiment the angles and dimensions relatively of the conical inner walls of the spout are preferred and important for best results, and accordingly all disclosure is hereby incorporated from the the parent Application identified above, by reference hereinto, as an intimate and working part of the present invention in a preferred embodiment thereof, basic differences being merely in the enlargement of dimensions for this larger unit.

THE FIGURE

The FIGURE illustrates in side cross-sectional view the heavy-duty drain-flushing device of the present invention, in exploded view.

DETAILED DESCRIPTION OF THE INVENTION

The entire disclosure of the parent application by the same title, having Ser. No. 545,436, filed Jan. 30, 1975, is hereby incorporated by reference hereinto as an intimate part of the present disclosure, all features of that invention constituting a preferred embodiment of the present improved invention.

The FIGURE discloses a sturdy reinforced handle 17 intimate with the upper outer end **15*a* of the shaft 15 of which the lower end 15*b* is rigidly mounted onto the piston compressor 16 separating upper space 19 from lower space 20 within the cylinder 12 having upper open end 23 capped by the piston shaft support 13 having support aperture 14 and venting openings 18. Shown in phantom is the position of the rigidly mounted spout element 6 having outlet restricted aperture 22 defined by inner conical wall 11 around space 21 which in the mounted state is continuous with space 20 of the cylinder when the upper end 9 of circumscribing mating wall 7 is mounted around the lower end of the cylinder 12.**

The flange 10 flares radially outwardly and upwardly in a handle direction at about a 45° angle, although the exact number of degrees is not critical so long as the flange angles upwardly to a significant amount as to enable the lower cylindrical end 9' of the spout element 6 to become substantially automatically centered within an opening as a result of the upwardly flared flange, whenever the compressor casing 12 is pressed downwardly into a drain opening. It is noted that the cylindrical wall 9' serves to aid the firm seating within the drain opening to prevent excessive shifting possibilities during the holding down of the cylinder 12 while the piston shaft 15 is forced downwardly by pressure on the handle 17.

It is within the scope of the present invention to make such modifications and substitution of equivalents as would be apparent to a person of ordinary skill in this particular field.

I claim:

1. A drain-flushing device comprising in combination: a cylindrical tubular element having an open end at one end thereof and having a conically restricted end at least on inner surfaces thereof at an opposite other end thereof defining an aperture of predetermined small diameter; a reciprocatable sealed disk mounted sealably within the cylindrical tubular element sealably isolating spaces on each of opposite sides of the reciprocatable sealed disk from one another; shaft means mounted within the cylindrical tubular element secured at one end thereof fixedly to the reciprocatable sealed disk and adapted fo reciprocating the reciprocatable sealed disk and extending at an opposite end thereof through and beyond said open end adapted for reciprocation axially within the cylindrical tubular element; a handle element mounted on a distal end of the shaft means at an end opposite from the attached said reciprocatable sealed disk, the handle element being adapted for manual grasping thereof for the pressing on the shaft means in a direction axially of the shaft means to thereby force liquid through the aperture at elevated pressure from one of the spaces adjacent the aperture; the outer surface of said conically restricted end being terminated at an apex of the conically restricted end as a structure devoid of further projection ending bluntly at the apex and said inner surfaces being at a conical angle of from about 40 degrees to about 50 degrees relative to the side surfaces of the cylindrical walls of the cylindrical tubular element, the improvement being and including a circumscribing radially-outwardly and upwardly flared flange spaced upwardly from and including a lower cylindrical wall circumscribing the conically restricted end.

2. A drain-flushing device of claim 1, in which the cylindrical element, the reciprocatable sealed disk, the shaft means, the handle element, and the flared flange comprise a predetermined large mass and bulk strength such that the device is suitable for heavy duty sevice with large drains.

* * * * *